United States Patent [19]

Mukunoki et al.

[11] Patent Number: 4,569,905

[45] Date of Patent: Feb. 11, 1986

[54] SILVER HALIDE PHOTOGRAPHIC LIGHT-SENSITIVE MATERIAL

[75] Inventors: Yasuo Mukunoki; Jiro Yamaguchi; Masakazu Yoneyama, all of Kanagawa, Japan

[73] Assignee: Fuji Photo Film Co., Ltd., Kanagawa, Japan

[21] Appl. No.: 714,417

[22] Filed: Mar. 21, 1985

[30] Foreign Application Priority Data

Mar. 24, 1984 [JP] Japan ..... 59-56869

[51] Int. Cl.[4] ..... G03C 7/26

[52] U.S. Cl. ..... 430/546; 430/631; 430/635; 430/636

[58] Field of Search ..... 430/546, 631, 635, 636

[56] References Cited

U.S. PATENT DOCUMENTS

| | | | |
|---|---|---|---|
| 4,198,478 | 4/1980 | Yoneyama et al. | 430/546 |
| 4,291,113 | 9/1981 | Minamizono et al. | 430/631 |
| 4,368,258 | 1/1983 | Fujiwhara et al. | 430/546 |
| 4,391,903 | 7/1983 | Sysak | 430/636 |

*Primary Examiner*—J. Travis Brown

*Attorney, Agent, or Firm*—Sughrue, Mion, Zinn, Macpeak and Seas

[57] ABSTRACT

A silver halide photographic light-sensitive material comprising a support having thereon at least one photographic silver halide emulsion layer. The light-sensitive material contains at least one hydrophilic organic colloid layer in which at least one photographically useful reagent is dispersed in the presence of a specific surface-active polymer. The polymer contains at least 5 mole % of units represented by the following general formula (I-1) or (I-2):

General formula (I-1)

General formula (I-2)

wherein $R_1$ represents a substituted or unsubstituted alkyl, alkenyl or aryl group having 1 to 30 carbon atoms, A and D each represents a single bond or a divalent linking group, $R_2$ represents a substituted or unsubstituted alkyl or aryl group, $R_3$ and $R_4$ each represents hydrogen or a substituted or unsubstituted alkyl or aryl group, $R_2$ and $R_3$ or $R_3$ and $R_4$ may respectively form a ring, X represents a single bond or a substituted or unsubstituted alkylene, alkenylene or arylene group, Y represents —COOM, —$SO_3$M, —O—$SO_3$M or in which M represents hydrogen or an inorganic or organic cation, $m_1$ is an integer of 1 to 3, and $m_2$ is 1 or 2. This photographic light-sensitive material does not contaminate processing solutions, and gives an image of good quality.

5 Claims, No Drawings

SILVER HALIDE PHOTOGRAPHIC LIGHT-SENSITIVE MATERIAL

FIELD OF THE INVENTION

This invention relates to a silver halide photographic light-sensitive material capable of decreasing the contamination of a photographic processing solution.

BACKGROUND OF THE INVENTION

Various inorganic and organic compounds have been known as photographically useful reagents. Organic photographically useful reagents include water-soluble, water-insoluble or sparingly water-soluble compounds. Among these water-insoluble and sparingly water-soluble compounds, oil-soluble photographically useful reagents such as dye image-forming couplers, dye providing redox compounds, ultra violet absorbing agents, antifading agents, color mixing preventing agents and their precursors have gained particularly widespread acceptance. These compounds are introduced into hydrophilic colloid layers, usually in a finely dispersed form.

Many techniques have so far been developed in regard to the emulsification and dispersion of such oil-soluble photographically useful reagents. For example, U.S. Pat. Nos. 2,739,888 and 3,352,681 describe techniques in regard to ultra violet absorbing agents. U.S. Pat. Nos. 2,360,290, 2,728,659 and 3,700,453 describe techniques regarding diffusion-resistant alkylhydroquinones used to prevent color fogging, color staining, color mixing, etc. In particular, methods are known which effect emulsification and dispersion of oil-soluble photographic additives by using monomeric anionic surface-active agents as emulsifying agents. For example, U.S. Pat. No. 2,332,027 describes a method involving the use of Gardinol WA (a trade name for sulfonated coconut fatty alcohol, a product of E. I. du Pont de Nemours & Co.) and triisopropylnaphthalenesulfonic acid salts; Japanese Pat. No. 428,191 describes a method involving the use of, as an emulsifying agent, a water-soluble coupler having both a sulfone or carboxyl group and a long-chain aliphatic group; and U.S. Pat. No. 3,676,141 describes a method involving the use of a combination of an anionic surface-active agent having a sulfo group and a nonionic surface-active agent of the anhydrohexyl ester type. These emulsifying and dispersing methods, however, give coarse dispersed particles and cannot form fine particles of less than about 0.3 μm in size required in the recent technology of photographic light-sensitive materials. Particularly, in the designing of a color photographic light-sensitive material, photographic elements (i.e., photographic layers) coated on a support are thick. If emulsion particles to be added thereto are coarse, light scattering which adversely affects the photographic properties of the light-sensitive material occurs during passage of the light through the photographic elements. This makes the photographic light-sensitive material opaque, and may cause a deterioration in the quality of images in regard to image sharpness, granularity, etc.

The surface-active polymer disclosed in Japanese Patent Application (OPI) No. 138726/78 (the term "OPI" as used herein refers to a "published unexamined Japanese patent application") gives a fine dispersion having excellent stability and can lead to the production of a photographic light-sensitive material in which or on the surface of which crystals of the aforesaid organic photographically useful reagents hardly precipitate. However, photographic light-sensitive materials obtained by using a dispersion of photographically useful reagents in water or a hydrophilic colloid composition together with such a surface-active polymer cause "contamination of processing solutions" as will be described hereinbelow, and consequently are reduced in merchandize value. The "contamination of processing solutions", as used herein, means the formation of a tarry substance called "scum" on the surface of a developing solution or on a wall surface.

If the hydrophilicity of the surface-active polymer is reduced by decreasing the proportion of the sulfonic acid group units or increasing the hydrophobic groups in order to prevent the surface-active polymer from being dissolved in the processing solution, the contamination of the processing solution is reduced, but the dispersed particles become coarse and drastically reduces the quality of the resulting image. If, conversely, the hydrophilicity of the polymer is increased by increasing the proportion of the sulfonic acid group units or decreasing the hydrophobic groups, the contamination of the processing solution cannot be reduced, and the dispersed particles become coarse.

For this reason, even when the structure of the surface-active polymer is varied within the range described in Japanese Patent Application (OPI) No. 138726/78, it is impossible to reduce the contamination of processing solutions and simultaneously provide finely dispersed particles.

SUMMARY OF THE INVENTION

A first object of this invention is to provide a silver halide photographic light-sensitive material in which photographically useful reagents are finely dispersed in a hydrophilic colloid layer to avoid contamination of a processing solution.

A second object of this invention is to provide a silver halide photographic light-sensitive material which is easy to produce and which does not cause flocculation and crystal precipitation of dispersed emulsion particles on long-term storage.

These and other objects of the invention are achieved by a silver halide photographic light-sensitive material comprising a support having thereon at least one photographic silver halide emulsion layer, said light-sensitive material containing at least one hydrophilic organic colloid layer in which at least one photographically useful reagent is dispersed in the presence of a surface-active polymer, said polymer containing at least 5 mole% of units represented by the following general formula (I-1) or (I-2):

General formula (I-1)

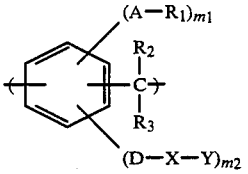

General formula (I-2)

-continued

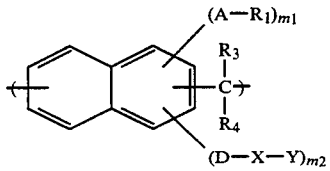

wherein $R_1$ represents a substituted or unsubstituted alkyl, alkenyl or aryl group having 1 to 30 carbon atoms, A and D each represents a single bond or a divalent linking group, $R_2$ represents a substituted or unsubstituted alkyl or aryl group, $R_3$ and $R_4$ each represents hydrogen or a substituted or unsubstituted alkyl or aryl group, $R_2$ and $R_3$ or $R_3$ and $R_4$ may respectively form a ring, X represents a single bond or a substituted or unsubstituted alkylene, alkenylene or arylene group, Y represents —COOM, —$SO_3M$, —O—$SO_3M$ or

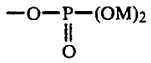

in which M represents hydrogen or an inorganic or organic cation, $m_1$ is an integer of 1 to 3, and $m_2$ is 1 or 2.

DETAILED DESCRIPTION OF THE INVENTION (i) Surface-active polymer

Compounds containing units of general formula (I-1) or (I-2) used in this invention are especially useful as emulsifying agents and dispersants.

General formula (I-1)

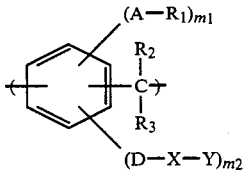

General formula (I-2)

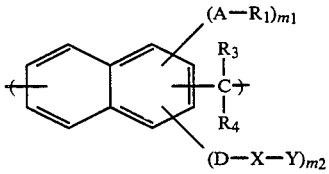

In the above formulae, $R_1$ represents a substituted or unsubstituted alkyl, alkenyl or aryl group having 1 to 30 carbon atoms, A and D each represents a single bond or a divalent linking group, $R_2$ represents a substituted or unsubstituted alkyl or aryl group, $R_3$ and $R_4$ each represents hydrogen or a substituted or unsubstituted alkyl or aryl group, $R_2$ and $R_3$ or $R_3$ and $R_4$ may respectively form a ring, X represents a single bond or a substituted or unsubstituted alkylene, alkenylene or arylene group, Y represents —COOM, —$SO_3M$, —O—$SO_3M$ or

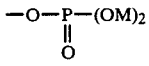

in which M represents hydrogen or an inorganic or organic cation, $m_1$ is an integer of 1 to 3, and $m_2$ is 1 or 2.

Examples of the substituents for the substituted alkyl, alkenyl or aryl group represented with $R_1$, the substituted alkyl or aryl group represented with $R_2$, the substituted alkyl or aryl group represented with $R_3$ and $R_4$ and the substituted alkylene, alkenylene or arylene group represented with X include a hydroxyl group, an alkyloxy group, an alkyloxycarbonyl group, a halogen atom, an alkylthio group and an alkylsulfamoyl group.

The surface-active polymer used in this invention contains at least 5 mole%, preferably at least 10 mole%, of the units represented by general formula (I-1) or (I-2). These units include divalent units composed of a benzene ring having a substituted methylene group or a naphthalene ring having an unsubstituted methylene group. The benzene or naphthalene ring may be substituted, preferably by at least one substituent. Examples of such substituents include alkyl groups preferably having 3 to 22 carbon atoms such as propyl, butyl, octyl, nonyl, dodecyl and octadecyl groups, halogen atoms such as chlorine, bromine and iodine atoms, a hydroxyl group, alkoxy groups with the alkyl moiety preferably having 3 to 22 carbon atoms such as octyloxy, hexyloxy, dodecyloxy and β-hydroxyethoxy groups, and haloalkoxy groups with the alkyl moiety preferably having 3 to 22 carbon atoms such as β-chloroethoxy and β-bromoethoxy groups.

The molecular weight of the surface-active polymer used in this invention is not particularly restricted, but is preferably about 600 to about 10,000, especially preferably 900 to 5,000.

Specific examples of typical surface-active polymers used in this invention are shown below (the illustrated surface-active polymers contain the following structural units in the proportions indicated below).

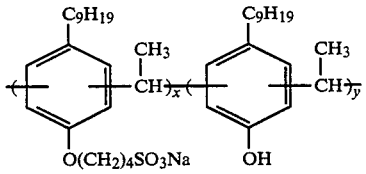

(1)

x:y = 8:2
x + y ≈ 10

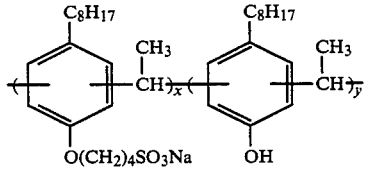

(2)

x:y = 1:1
x + y ≈ 8

-continued
(3)
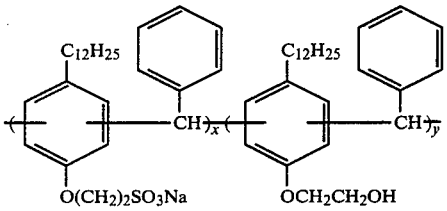
x:y = 7:3
x + y ≈ 6
(4)
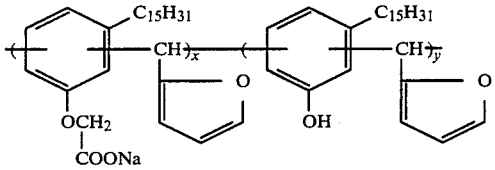
x:y = 8:2
x + y ≈ 7
(5)
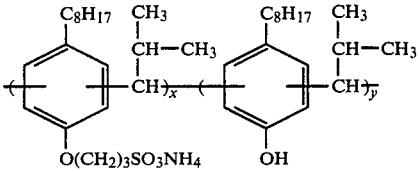
x:y = 4:6
x + y ≈ 5
(6)
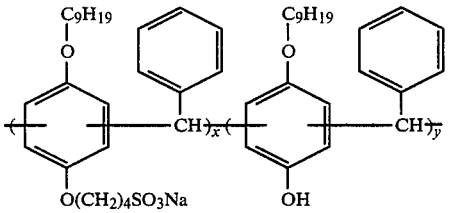
x:y = 2:8
x + y ≈ 6
(7)
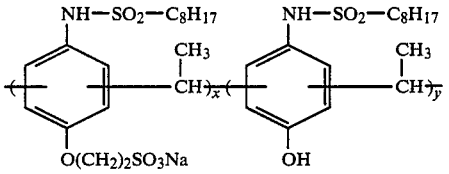
x:y = 3:7
x + y ≈ 6
(8)
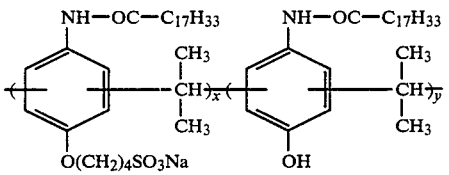
x:y = 1:1
x + y ≈ 4
(9)
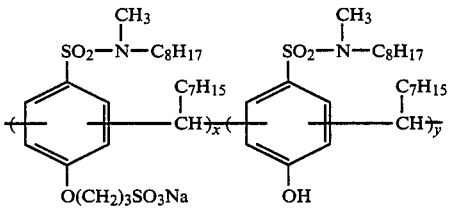
x:y = 9:1
-continued
x + y ≈ 5
(10)
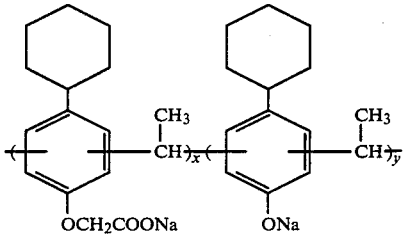
x:y = 6:4
x + y ≈ 8
(11)
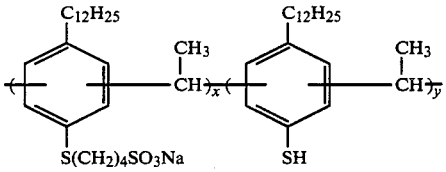
x:y = 9:1
x + y ≈ 7
(12)
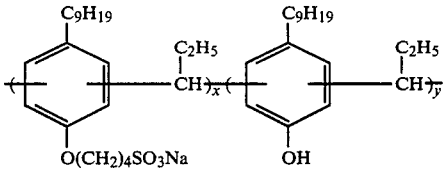
x:y = 55:54
x + y ≈ 10
(13)
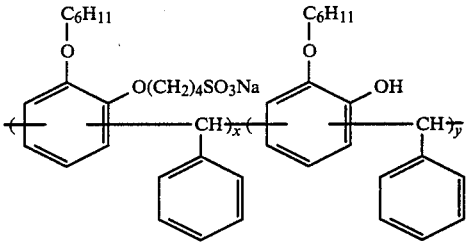
x:y = 4:6
x + y ≈ 7
(14)
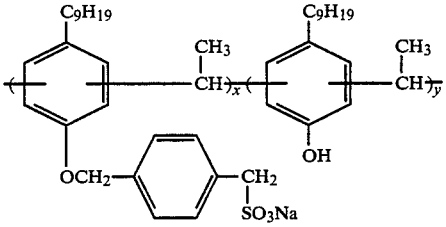
x:y = 1:1
x + y ≈ 10
(15)
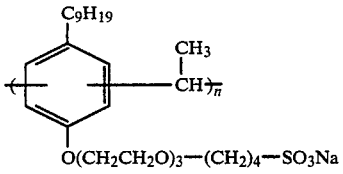
n ≈ 8

-continued

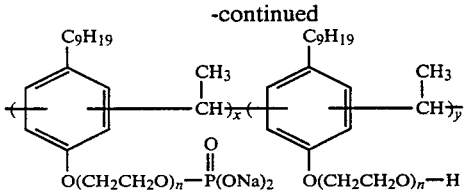

(16)

x:y = 1:1
x + y ≈ 7
n ≈ 5

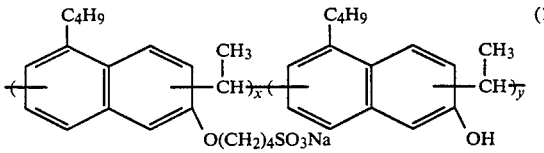

(17)

x:y = 1:1
x + y ≈ 5

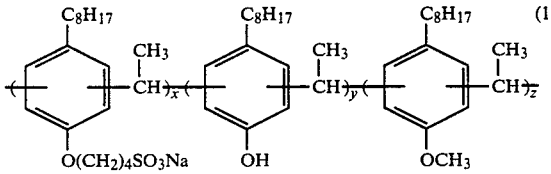

(18)

x:y:z = 5:3:2
x + y + z ≈ 10

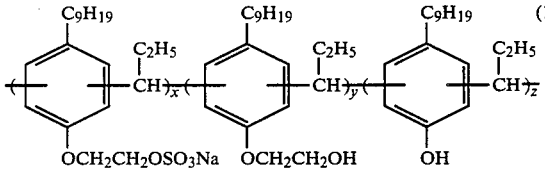

(19)

x:y:z = 3:3:1
x + y + z ≈ 7

These polymers used in this invention can be synthesized by conventional methods. For example, an alkylphenol/acetaldehyde polycondensate can be easily synthesized in accordance with the methods described in "Kogyo Kagaku Zasshi", Vol. 66, page 391 (1963) and "Oil Chemistry" (Japanese-language publication), Vol. 12, page 625 (1963).

Introduction of Y in general formulae (I-1) and (I-2) can be easily effected, for example, in accordance with the methods described in Ryohei Oda and Kazuhiro Teramura "Synthesis and Application of Surface-Active Agents" (a Japanese-language publication published by Maki Shoten), and U.S. Pat. Nos. 1,933,431, 1,968,793 and 2,005,619.

The surface-active polymer used in this invention may be added to one or both of an oil-soluble photographic reagent solution and an aqueous colloid solution (or an aqueous solution free from a hydrophilic colloid) in such amounts that its solubility permits.

(ii) Surface-active agents which can be used jointly with the surface-active polymers:

The surface-active polymer in accordance with this invention can be used not only alone, but also in combination with one or more non-polymeric surface-active agents. In some cases, it is preferably used in combination with a low-molecular-weight surface-active agent rather than alone. The surface-active polymer in accordance with this invention may be used in combination with an anionic surface-active agent and/or a nonionic surface-active agent.

The anionic surface-active agent is preferably a compound containing both a hydrophobic group having 8 to 30 carbon atoms and the group —$SO_3M$ or —O-$SO_3M$ group in which M is the same as defined for general formulae (I-1) and (I-1) in one molecule. Compounds of this type are described in Ryohei Oda and Kazuhiro Teramura "Synthesis and Application of Surface-Active Agents" (Maki Shoten) and A. W. Perry, "Surface-Active Agents" (Interscience Publications Inc., New York).

The nonionic surface-active agents and polyhydric alcohol/fatty acid ester type surface-active agents described in Japanese Patent Application (OPI) No. 30933/73 are preferred as the above nonionic surface-active agent. Preferably, the polyhydric alcohol/fatty acid ester type surface-active agents have at least 2, preferably at least 3, hydroxyl groups and 6 to 25 carbon atoms in the fatty acid moiety. Specifically, the nonionic surface-active agents of the sorbitan fatty acid ester type described in U.S. Pat. No. 3,676,141 are advantageously used in this invention.

Specific examples of the anionic surfactant are shown below.

$C_{12}H_{25}OSO_3Na$ (A-1)
$C_{14}H_{29}OSO_3Na$ (A-2)
Turkey red oil (A-3)

$C_{12}H_{25}CONH$ (A-4)
$NaO_3SOCH_2CH_2$ $C_{12}H_{25}SO_3Na$ (A-5)
$C_{14}H_{29}SO_3Na$ (A-6)

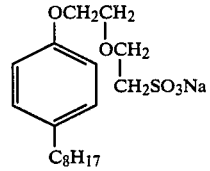

(A-7)

$NaO_3SCH—COOC_8H_{17}$ (A-8)
$CH_2—COOC_8H_{17}$

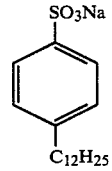

(A-9)

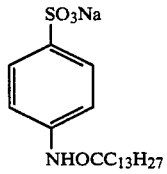

(A-10)

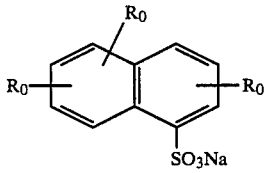

(A-11)

-continued

In the formula $R_0$ represents $-CH(CH_3)_2$.

(iii) Organic photographically useful reagent

The organic photographically useful reagents which can be used in this invention mean any organic reagents which are useful for photographic applications. The use of oil-soluble organic photographically useful reagents is preferred in this invention. The term "oil-soluble", as used herein, means that a given reagent dissolves in an organic solvent at room temperature (about 20° C.) in an amount of at least 3% by weight. The organic solvent, as referred to herein, means the organic solvents described, for example, in "Solvent Handbook". Examples of such organic solvents include methanol, ethanol, isopropanol, butanol, ethyl acetate, isopropyl acetate, acetone, methyl ethyl ketone, tetrahydrofuran, cyclohexanone, benzene, toluene, dioxane, acetonitrile, dichloromethane and chloroform.

The photographically useful reagents that can be used in this invention include, for example, dye image-forming couplers, dye image providing redox compounds, ultra violet absorbing agents, electron donors used for the purpose of preventing color mixing, oxidation, fading, etc., antifoggants, development restrainers, developing agents, fogging agents, silver halide solvents, bleaching accelerators, dyes for filters, and precursors of these compounds.

(a) Couplers

Preferred photographically useful reagents include dye image-forming couplers which couple with the oxidation products of aromatic primary amine developing agents to form colored or colorless dyes. Examples of couplers forming colored dyes are yellow, magenta and cyan couplers.

Examples of the yellow couplers are couplers of the pivaloyl acetanilide, benzoyl acetanilide, malonic diester, malonic diamide, dibenzoyl methane, benzothiazolyl acetamide, malonic ester monoamide, benzothiazolyl acetate, benzoxazolyl acetamide, benzoxazolyl acetate, benzimidazolyl acetamide and benzimidazolyl acetate types, the couplers derived from hetero ring substituted acetamide or hetero ring substituted acetate as disclosed in U.S. Pat. No. 3,841,880, the couplers derived from acyl acetamides described in U.S. Pat. No. 3,770,446, British Pat. No. 1,459,171, West German Patent Application (OLS) No. 2,503,099, Japanese Patent Application (OPI) No. 139738/75 and Research Disclosure No. 15737, and the heterocyclic couplers described in U.S. Pat. No. 4,046,574.

Generally, open-chain ketomethylene-type couplers are especially preferred among the above yellow couplers.

Examples of the magenta couplers include couplers of the 5-oxo-2-pyrazoline, pyrazolobenzimidazole, cyanoacetophenone and pyrazoloimidazole types, the N-hetero ring substituted acylacetamide-type couplers described in West German Patent Application (OLS) No. 3,121,955, the 1H-pyrazolo[5,1-c][1,2,4]triazole-type couplers described in U.S. Pat. No. 3,725,067 and British Pat. Nos. 1,252,418 and 1,334,515, and the 1H-pyrazolo[1,5-b][1,2,4]triazole-type couplers described in Japanese Patent Application No. 45512/83 (corresponding to U.S. patent application Ser. No. 590,818 filed on Mar. 19, 1984).

Phenol or naphthol derivatives are mainly used as the cyan couplers.

Colored couplers that can be used may be those described in U.S. Pat. Nos. 2,521,908, 3,034,892, 3,476,560 and 4,138,258, Japanese Patent Publication Nos. 22335/63, 11304/67, 2016/69 and 32461/69, Japanese Patent Application No. 118020/75, and West German Patent Application No. 2,418,959.

Couplers (DIR couplers) of the type which releases a development inhibitor or a precursor thereof corresponding to the amount of developed silver during development, couplers (DAR couplers) of the type which releases a fogging agent or a development accelerator, and couplers of the type which releases an electron donor may also be used as the photographically useful reagents in accordance with this invention.

Colorless couplers or colorless DIR couplers can also be used. Examples of coupler residues which do not substantially form dyes are residues of couplers of the indanone or acetophenone type.

The above couplers, etc. may be used in a combination of two or more in the same layer in order to provide the characteristics required of the desired photographic light-sensitive material.

Some examples of the couplers are given below.

Yellow-forming couplers (Y-1)

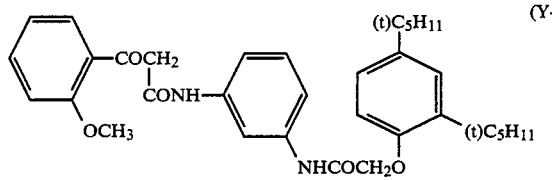

(Y-2)

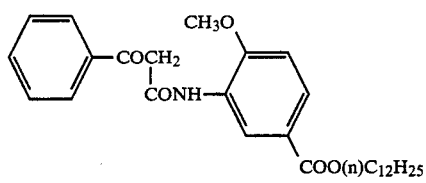

(Y-3)

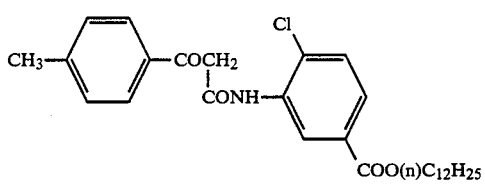

(Y-4)

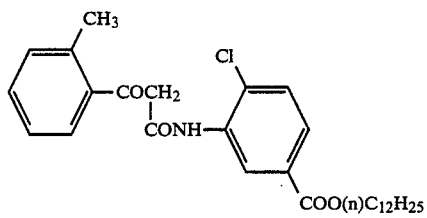

-continued
(Y-5)
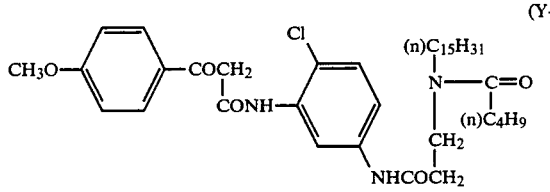
(Y-6)
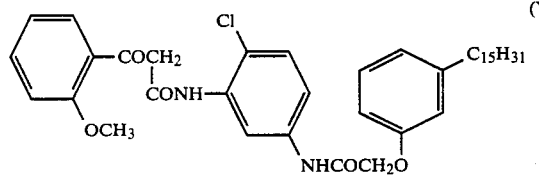
(Y-7)
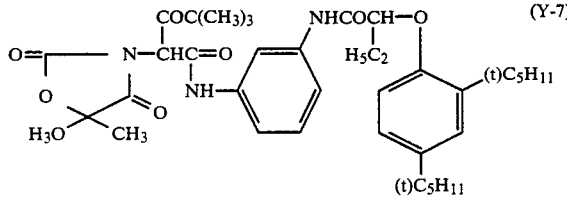
Magenta-forming couplers
(M-1)
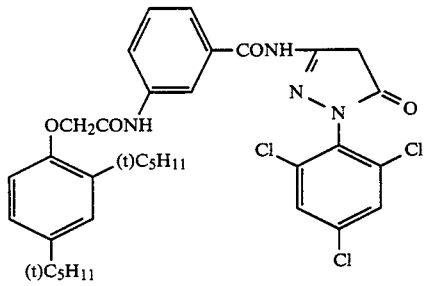
(M-2)
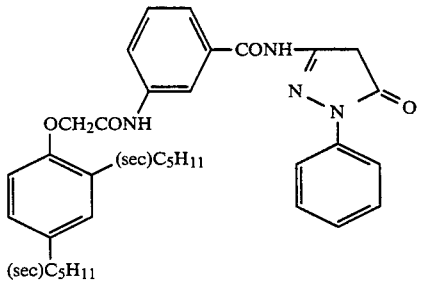
(M-3)
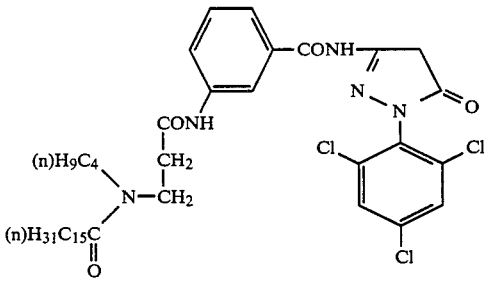
-continued
(M-4)
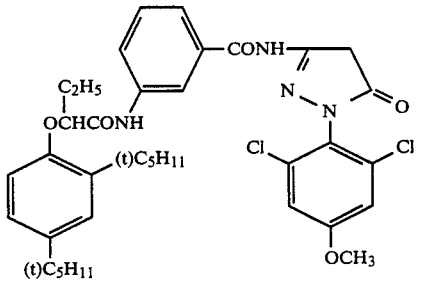
(M-5)
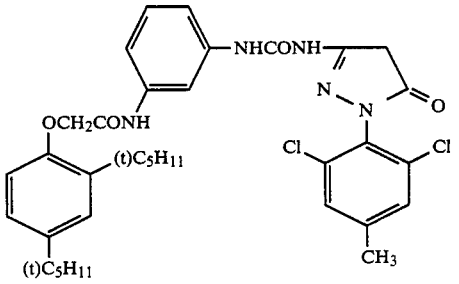
Cyan-forming couplers
(C-1)
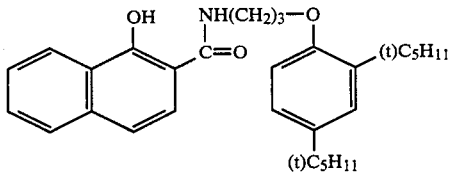
(C-2)
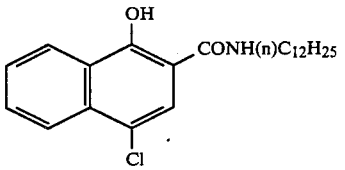
(C-3)
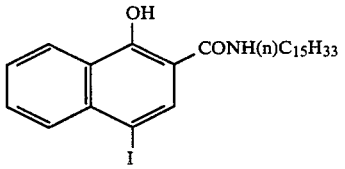
(C-4)
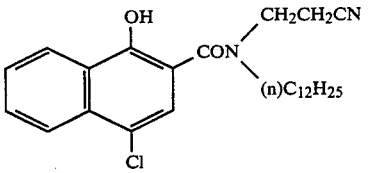
(C-5)
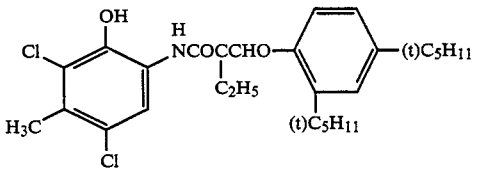

-continued
(C-6)
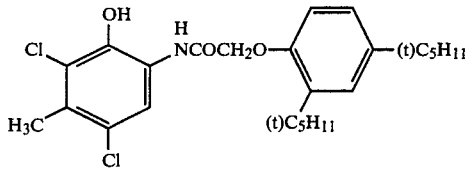
(C-7)
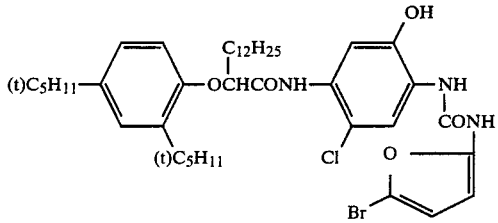
(C-8)
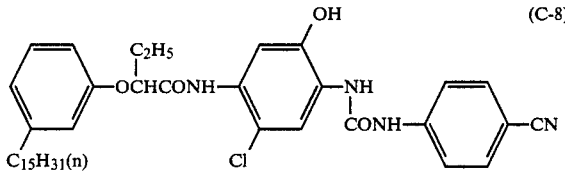
Mask-forming colored couplers
(L-1)
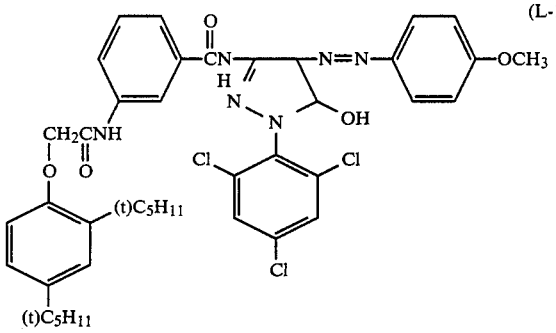
(L-2)
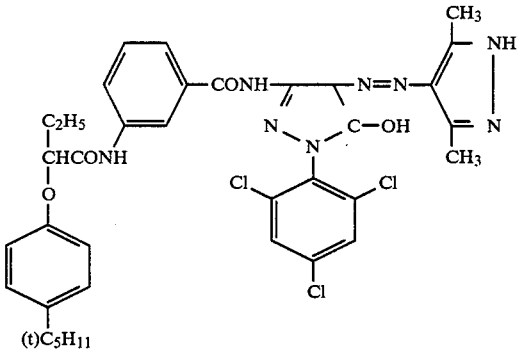
(L-3)
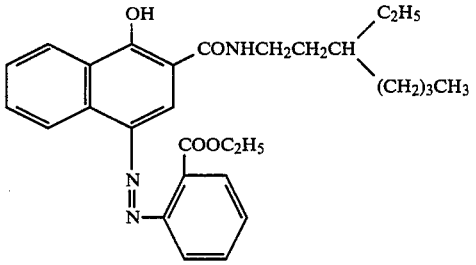
-continued
(L-4)
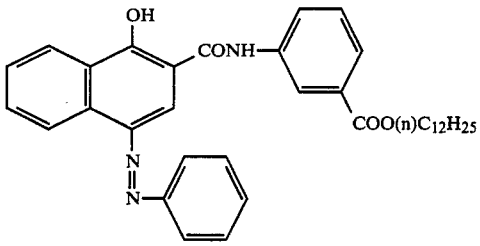
DIR couplers (releasing development inhibitors)
(N-1)
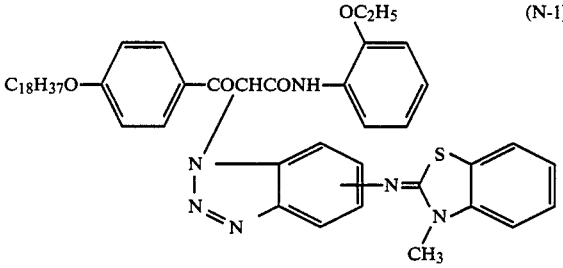
(N-2)
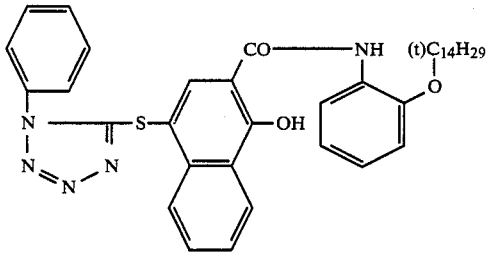
(N-3)
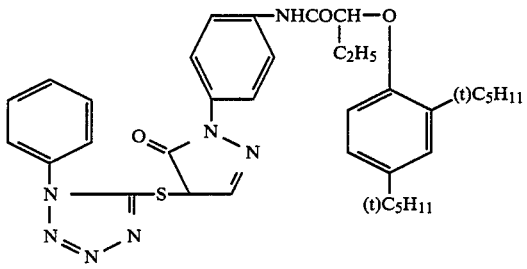
DAR couplers (releasing fogging agents)
(P-1)
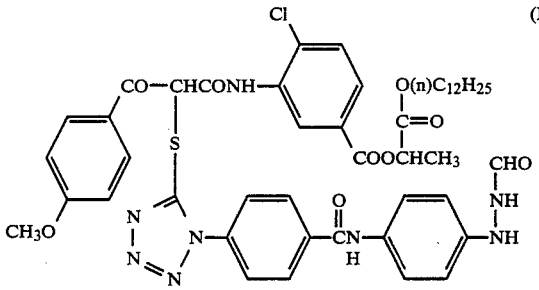
(P-2)
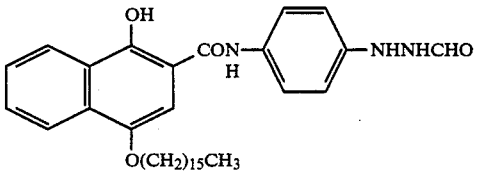

-continued

Electron donor releasing couplers (Q-1)

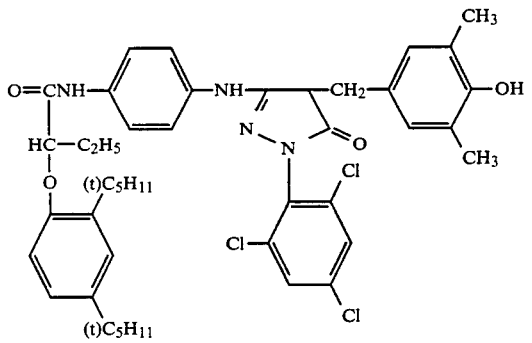

(b) Dye image providing compounds

Another photographically useful reagent which can be used in this invention is a dye image providing redox compound used in a color diffusion transfer photographic light-sensitive material. As is well known to those skilled in the art, this compound is of the negative or positive type, and is initially mobile or immobile in a photographic element when processed with an alkaline processing composition.

One example of the negative-type dye image providing compound useful in this invention is a coupler which forms or releases a dye by reaction with an oxidizing color-forming developing agent. Its specific examples are described, for example, in U.S. Pat. No. 3,227,550 and Canadian Pat. No. 602,207.

Preferably, the negative-type dye image providing compound for use in this invention is a dye releasing redox compound which reacts with a developing agent or an electron transfer agent in the oxidized state to release a dye. Typical specific examples thereof are described, for example, in Japanese Patent Application (OPI) Nos. 33826/73, 113624/76, 54021/79 and 71072/81. As an immobile positive-type dye image providing agent that can be used in this invention, there is a compound which releases a diffusible dye without receiving any electron (namely, without being reduced) during photographic processing under alkaline conditions, or after receiving at least one electron (namely, after it is reduced) during photographic processing under alkaline conditions.

A dye developing agent is an example of a positive-type dye image providing compound which is mobile under alkaline photographic processing conditions from the outset. This developing agent is also effective in this invention. Its typical specific examples are described, for example, in Japanese Patent Publication No. 32130/73 and 22780/80.

The dye formed from the dye image providing compound used in this invention may be an already formed dye or a dye precursor which can be converted to a dye in the step of photographic processing or in the step of an additional treatment. The final dye image may, or may not, be metallized. Typical dye structures useful in this invention may be azo dyes, azomethine dyes, anthraquinone dyes and phthalocyanine dyes which are metallized or non-metallized. Of these, cyan, magenta and yellow dyes of the azo type are especially important.

As a kind of dye precursors, dye releasing redox compounds having a dye portion whose light absorption is temporarily shifted in a photographic element can also be used in this invention.

Dye releasing redox compounds (DRR compounds) are especially preferred as the dye image providing compounds used in this invention. Specific examples thereof are described, for example, in Japanese Patent Application (OPI) Nos. 33826/73, 113624/76, 54021/79 and 71072/81. Specific examples of redox moieties which are cross-oxidized by the development of silver halide and release diffusible dyes under alkaline conditions are shown below.

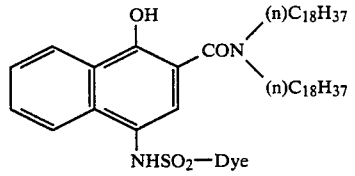

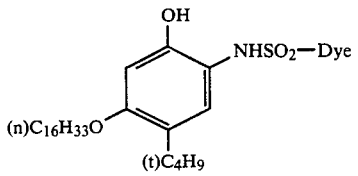

Another type of especially preferred dye image providing compounds includes those of the positive type described in Japanese Patent Application (OPI) Nos. 110827/78, 110828/78 and 164342/81. Specific examples of redox moieties of this type are shown below.

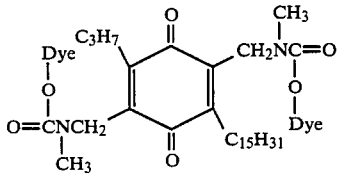

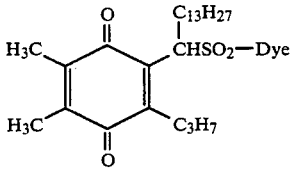

Specific examples of the dye releasing redox compounds are given below.

(DR-1)

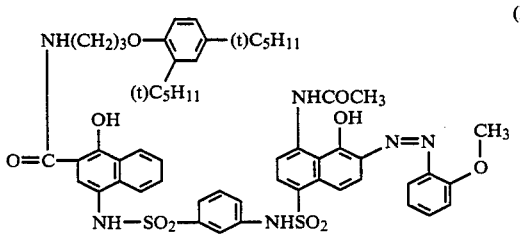

-continued
(DR-2)
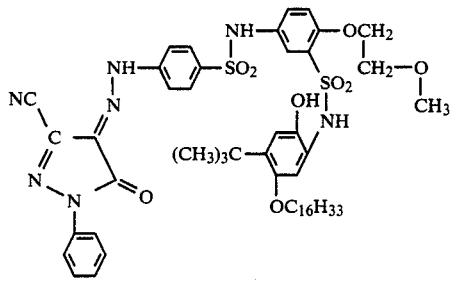
(DR-3)
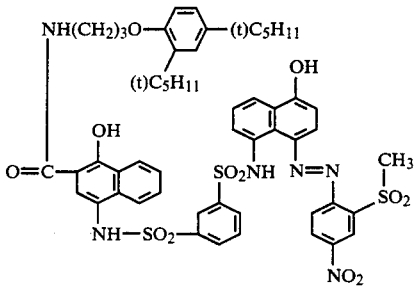
(DR-4)
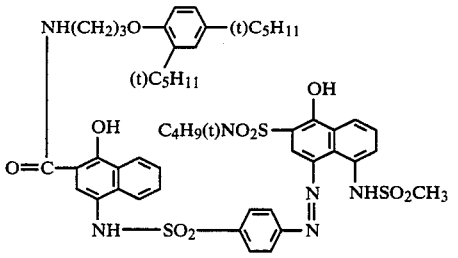
(DR-5)
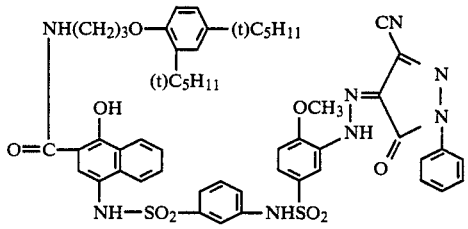
(DR-6)
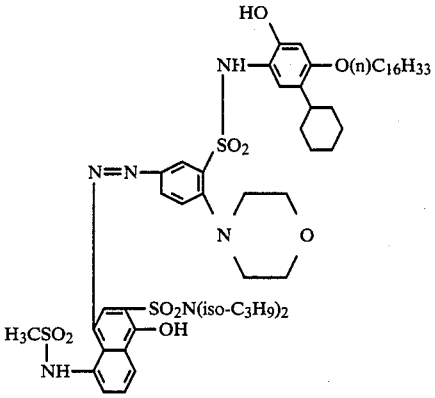
-continued
(DR-7)
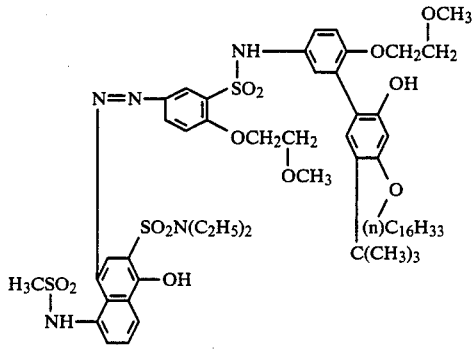
(DR-8)
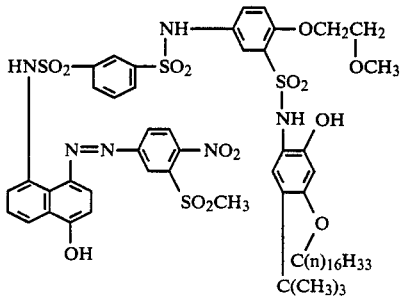
(DR-9-DR-12)
Products resulting from linking of the following dye moieties to the following redox moiety.
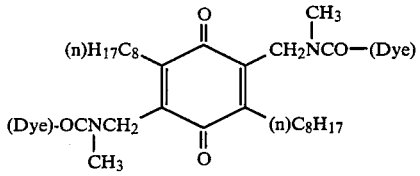
The followings are the dye moieties. The asterisk shows the site of linking to the above-described moiety.
(Dye moiety for DR-9)
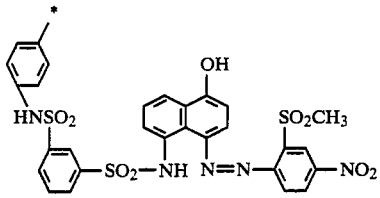
(Dye moiety for DR-10)
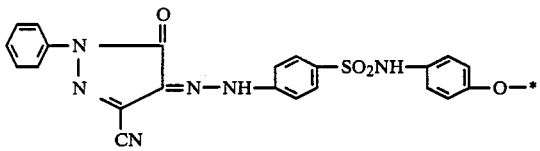
(Dye moiety for DR-11)

-continued

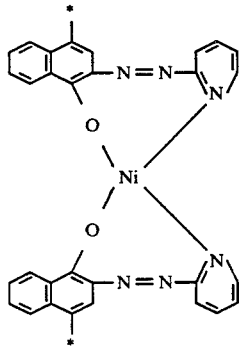

(Dye moiety for DR-12)

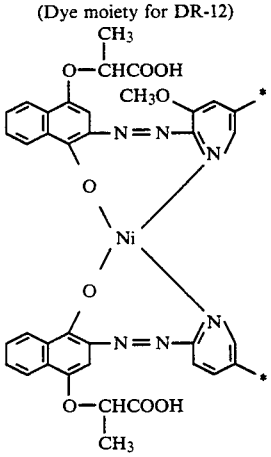

(DR-13)

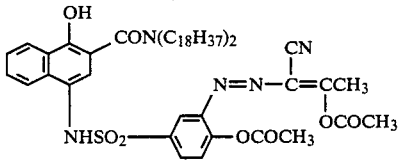

(DR-14)

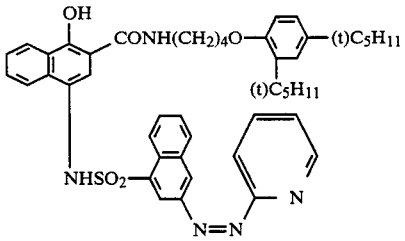

Some specific examples of color developing agents that can be used in the present invention are shown below.

(DD-1)

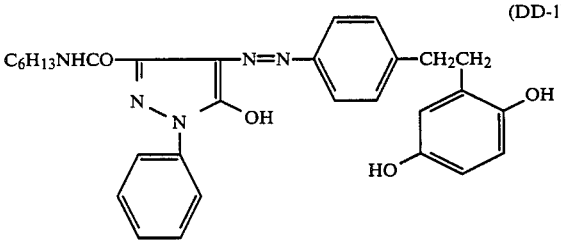

-continued (DD-2)

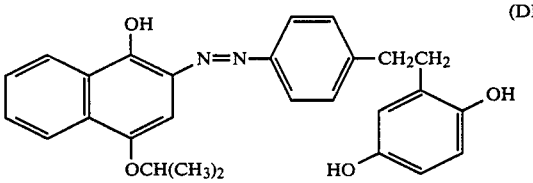

(DD-3)

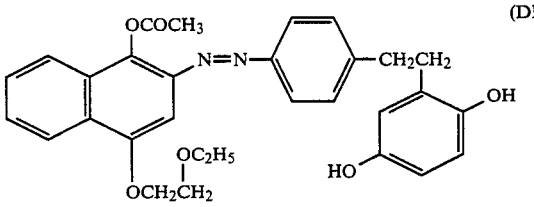

(DD-4)

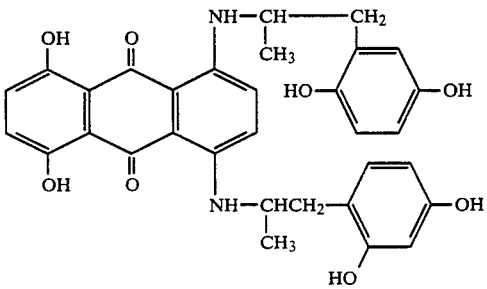

(c) Ultra violet absorbing agents

Ultra violet absorbing agents suitable for the practice of this invention are described, for example, in Japanese Patent Publication Nos. 21687/67 and 5496/73, Japanese Patent Application (OPI) No. 1026/72, and British Pat. No. 1,293,982.

In this invention, oil-soluble ultra violet absorbing agents are especially preferred. Some specific examples of the oil-soluble ultra violet absorbing agents suitable for the practice of this invention are given below.

(U-1)

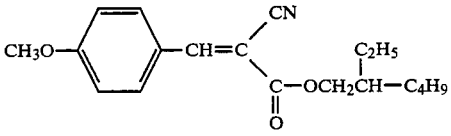

(U-2)

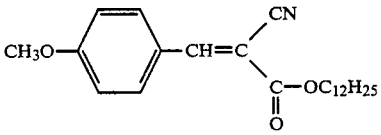

(U-3)

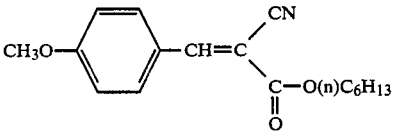

(U-4)

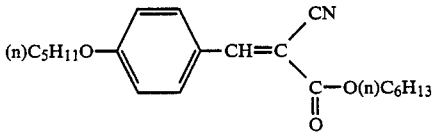

-continued

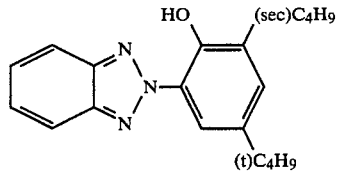

(U-5)

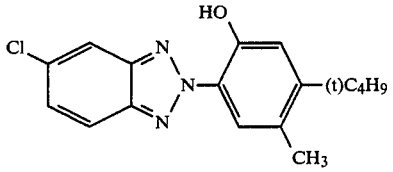

(U-6)

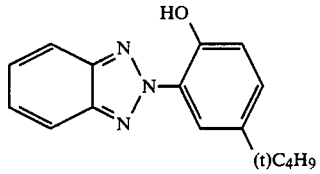

(U-7)

(d) Other organic photographically useful reagent that can be used in this invention Other photographically useful reagents which can be used in this invention include electron donors (to be referred to as "ED" hereinafter) which can give at least one electron to oxidized-type dye providing compounds or oxidation products of color developing agents. Compounds having a partial structure of Kendall-Pliz as described in T. H. James, "The Theory of the Photographic Process", 4th Edition, Chapter 11 are examples of effective ED compounds. Hydroquinones, catechols, o-aminophenols and p-aminophenols are within this group. Desirably, the ED compounds used in this invention are lowly diffusible when incorporated in any layer of photographic light-sensitive material. Lowly diffusible or non-diffusible hydroquinones and pyrogallols are widely used as color mixing preventing agents, oxidation preventing agents, antifading agents, etc. Specific examples include 2,5-di-n-octylhydroquinone, 2,5-d-t-pentadecylhydroquinone, n-dodecyl gallate, and p-laurylamide pyrogallol.

Compounds suitable for use in combination with positive-type dye image providing compounds may be cited as an example of ED precursors that can be used in this invention. Examples include the saccharin-type compounds described in U.S. Pat. No. 4,263,393, and the active methine-type compounds described in U.S. Pat. No. 4,278,750. Specific examples are given below.

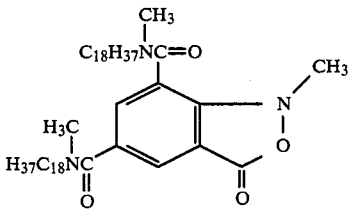

(ED-1)

-continued

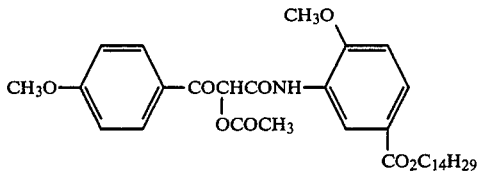

(ED-2)

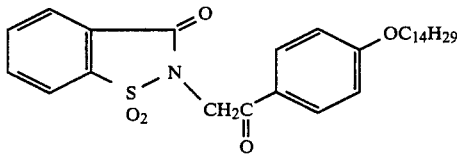

(ED-3)

Examples of other photographically useful reagents that can be used in this invention include antifoggants or development inhibitors typified by mercaptotetrazoles, mercaptotriazoles, mercaptopyrimidines, mercaptobenzimidazoles, mercaptothiadiazoles, benzotriazoles and imidazoles; developing agents such as p-phenylenediamines, hydroquinones and p-aminophenols; auxiliary developing agents typified by pyrazolidones; foggants such as hydrazines and hydrazides; silver halide solvents, such as hypo(sodium thiosulfate); bleaching accelerators such as aminoalkylthiols; and dyes such as azo dyes and azomethine dyes. Precursors of the above photographic reagents, and photographic reagents which further have the function of a redox during development capable of releasing the aforesaid photographic reagents, for example the dye materials for color diffusion transfer photographic light-sensitive materials mentioned earlier, and DIR- or DAR-hydroquinones can also be cited as useful photographic reagents. The aforesaid photographically useful reagents may be bonded through timing groups. Examples of such timing groups include those which release photographically useful reagents by intramolecular cyclizing reaction as described in Japanese Patent Application (OPI) No. 145135/79, those which release photographically useful reagents by intramolecular electron transfer as described in British Pat. No. 2,072,363 and Japanese Patent Application (OPI) No. 154234/82, those which release photographically useful reagents with the liberation of carbon dioxide gas as described in Japanese Patent Application (OPI) No. 179842/82, and those which release photographically useful reagents with the liberation of formaldehyde as described in Japanese Patent Application No. 203446/82 (corresponding to U.S. patent application Ser. No. 553,262 filed on Nov. 18, 1983).

Examples of the precursors of antifoggants or development inhibitors are given below.

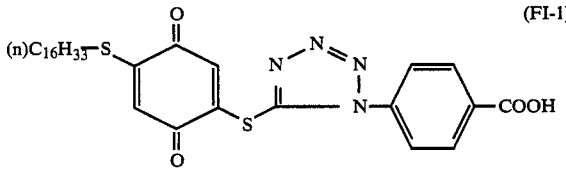

(FI-1)

-continued (FI-2)

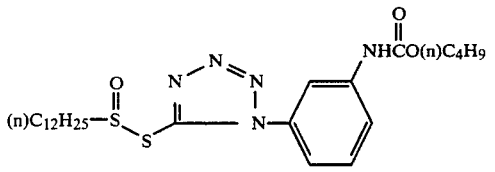

(FI-3)

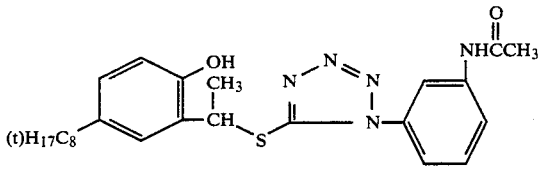

(FI-4)

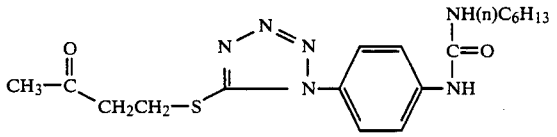

(iv) Dispersion of organic photographically useful reagents

Preferably, before emulsifying and dispersing the photographically useful reagents in this invention, they are melted by heat or dissolved in an organic solvent. Compounds capable of being directly emulsified by melting are limited to those having a melting point of less than about 90° C.

Useful organic solvents (so-called oils) having high boiling points which are used to disperse the oil-soluble photographically useful reagents finely in aqueous media are those which are virtually insoluble in water and have a boiling point of at least 190° C. under atmospheric pressure. Such organic solvents may be selected from carboxylic acid esters, phosphoric acid esters, carboxylic acid amides, ethers, substituted hydrocarbons and surface-inactive hydrophobic organic polymers. Specific examples include di-n-butyl phthalate, di-isooctyl phthalate, dimethoxyethyl phthalate, di-n-butyl adipate, di-isooctyl azelate, tri-n-butyl citrate, butyl laurate, di-n-butyl sebacate, tricresyl phosphate, tri-n-butyl phosphate, tri-isooctyl phosphate, N,N-diethylcaprylamide, N,N-dimethylpalmitamide, n-butyl-m-pentadecyl phenyl ether, methyl-2,4-tert-butyl phenyl ether, chlorinated paraffin, poly(ethyl acrylate) and a polyester derived from diethylene glycol and adipic acid.

Since the surface-active polymer used in this invention has low solubility in water, it does not greatly reduce surface tension, but is very effective for lowering interfacial tension. Because of this, it brings about the advantage of not forming bubbles during dispersion. The effect of this invention is attributed presumably to the mechanism in which the surface-active polymer forms a dispersion of itself in water and gains a kind of high-boiling organic solvent-like action.

It is sometimes advantageous in this invention to use such solvents in combination with low-boiling organic solvents (preferably those having a boiling point of not more than 130° C. under atmospheric pressure and being partially miscible with water), or water-soluble organic solvents in order to dissolve the oil-soluble photographically useful reagents in this invention. Examples of such other solvents are propylene carbonate, methyl acetate, ethyl acetate, isopropyl acetate, butyl acetate, ethyl propionate, sec-butyl alcohol, methyl ethyl ketone, 2-pentanone, 3-pentanone, cyclohexanone, dimethylformamide and dimethyl sulfoxide. The preferred amount of such solvents is 0.1 to 100 times the weight of the oil-soluble photographically useful reagent.

In the present invention, a hydrophilic organic colloid layer containing a dispersion of a photographically useful reagent is preferably in a water-permeable relation to a photographic silver halide layer.

A high-speed stirring-type dispersing machine having a high shear force and a dispersing machine capable of giving an ultrasonic energy of high intensity may, for example, be named as an emulsifying device for use in practicing the present invention. Specific examples include a colloid mill, a homogenizer, a capillary tube-type emulsifying device, a liquid siren, an electromagnetic strain type ultrasonic generator, and an emulsifying device having a Pohlman whistle. Preferred high-speed stirring-type dispersing machines for use in this invention are of the type whose principal portion having a dispersing action rotates at high speeds in a liquid (at 500 to 15,000 rpm, preferably 2,000 to 4,000 rpm), such as a dissolver, Polytron, a homomixer, a homoblender, a Keddy mill and a jet agitator. An especially preferred high-speed stirring-type dispersing machine for use in this invention is comprised of a shaft rotating at high speeds and mounted on it, an impeller composed of a sawtooth-like blade bent alternately in the vertical direction, which is described, for example, in U.S. Pat. No. 4,349,455 and is called a dissolver or a high-speed impeller dispersing machine.

Various processes can be used to prepare a dispersion of a photographically useful reagent in the form of oil droplets in water (to be referred to as the "aqueous dispersion") in accordance with this invention. The photographically useful reagent is dissolved in the high-boiling organic solvent or the low-boiling solvent or in a mixture of both, and then, the solution is dispersed in water or a hydrophilic colloid composition in the presence of the surface-active polymer of this invention. In this case, the surface-active polymer in accordance with this invention is included in either one of the solution containing the photographically useful reagent and water or the hydrophilic colloid solution.

When the surface-active polymer in accordance with this invention is to be present together with the photographically useful reagent, it is desirable to use therewith a substantially water-immiscible low-boiling organic solvent capable of forming a true solution of both the surface-active polymer and the photographically useful reagent. Many of the surface-active polymers in accordance with this invention are readily soluble in low-boiling solvents selected from ethyl acetate, methyl ethyl ketone, cyclohexanone and water.

Since many of the surface-active polymers in accordance with this invention have low solubility in water, they are desirably in the form of an aqueous emulsion when they are present together with water or the hydrophilic colloid composition.

The aqueous emulsion of the surface active agent used in this invention may be prepared by (1) a method which comprises dissolving the surface-active agent in an organic solvent, and emulsifying it in water in a customary manner by using such an emulsifying device as a colloid mill, a homogenizer, a dissolver or an electromagnetic strain-type ultrasonic generator; or (2) a method which comprises dissolving the surface-active polymer in a mixture of an organic solvent and water and distilling off the organic solvent to perform self-emulsification.

An example of preparing the aqueous emulsion of the surface-active agent is described in Japanese Patent Application No. 200862/82 (corresponding to U.S. patent application Ser. No. 552,118 filed on Nov. 15, 1983).

Alternatively, in the preparation of an aqueous dispersion of the surface-active polymer in accordance with this invention together with a photographically useful reagent, a usual dispersing method may be used in which a solution of the photographically useful reagent is dispersed in water or an aqueous colloid. Or there may be used a dispersing method in which water or the hydrophilic colloid composition is gradually added to the solution of the photographically useful reagent, with the phase transition from a W/O type to an O/W type. After the preparation of the aqueous dispersion, the water soluble binder may be dissolved into the dispersion directly or as an aqueous solution thereof. After the preparation of the aqueous dispersion, the low-molecular-weight organic solvent may be removed. For this purpose, various methods can be used. For example, the organic solvent may be distilled off, preferably under reduced pressure. Or it may be removed by using an ultrafiltration membrane, or by dialysis. Or the gel of the hydrophilic colloid composition can be washed with water.

The optimal amount of the surface-active polymer used in this invention varies depending upon the type of the photographically useful reagent used, the type and amount of the high-boiling organic solvent and at times, upon the type and amount of the low-molecular-weight surface-active agent used therewith. A suitable amount is within the range of 0.1 to 300% by weight, preferably 0.5 to 50% by weight, based on the substance to be dispersed.

According to this invention, the oil-soluble photographically useful reagent may be dispersed stably either in water or in the hydrophilic colloid composition, preferably in the latter.

Binders or protective colloids normally used in silver halide photographic light-sensitive materials may be used as the hydrophilic colloid in the hydrophilic colloid composition used in this invention.

Gelatin is advantageously used as the binder or protective colloid for photographic emulsions. Other hydrophilic colloids may also be used. Examples of the other hydrophilic colloids include proteins such as gelatin derivatives, graft polymers of gelatin with other polymers, albumin and casein; cellulose derivatives such as hydroxyethyl cellulose, carboxymethyl cellulose and cellulose sulfate; sugar derivatives such as starch derivatives and sodium alginate; and synthetic hydrophilic polymeric substances such as polyvinyl alcohol, a partial acetal of polyvinyl alcohol, poly-N-vinylpyrrolidone, polyacrylic acid, polymethacrylic acid, polyacrylamide, polyvinylimidazole, and polyvinylpyrazole, and copolymers thereof.

Gelatin may be lime-processed gelatin, acid-processed gelatin, gelatin hydrolysate, and an enzymatically decomposed product of gelatin. The gelatin derivatives may be those obtained by reacting gelatin with various compounds such as acid halides, acid anhydrides, isocyanates, bromoacetic acid, alkanesultones, vinylsulfonamides, maleimide compounds, polyalkylene oxides and epoxy compounds.

In the photographic light-sensitive material of this invention, at least one photographically useful reagent is dispersed by the aid of the surface-active polymer containing at least 5 mole% of the units of general formula (I-1) or (I-2). Hence, a fine aqueous dispersion having high stability can be obtained without bubble formation during dispersion. Consequently, the resulting silver halide photographic light-sensitive material does not contaminate processing solutions and gives images of good quality.

The following Examples illustrate the present invention in more detail. The invention, however, is not to be limited thereby.

Unless otherwise specified, all percents, ratios, etc. are by weight.

EXAMPLE 1

Film samples were prepared as follows:

A mixture consisting of 10 g of a cyan-forming coupler (*1), 10 g of trinonyl phosphate, 1.0 g of a comparative polymer (1) or (2) shown below and 20 ml of ethyl acetate was heated at 65° C. to form a solution. The solution was added to 100 ml of an aqueous solution containing 10 g of gelatin to obtain a sample of a dispersion. This sample was used to form a red-sensitive layer of a comparative sample 10 or 11 shown in Table 1.

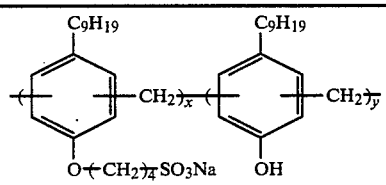

| | |
|---|---|
| Comparative polymer (1): | x:y = 5:5<br>x + y = 6 |
| Comparative polymer (2): | x:y = 2:8<br>x + y = 6 |

In the preparation of film samples using the compounds of this invention, a sample of a dispersion was obtained by the same procedure as in the preparation of the above dispersion except that the surface-active polymer (1), (3) or (6) shown in the Detailed Description of the Invention was used instead of the comparative polymer (1) or (2). The resulting dispersion sample was used in the red-sensitive layers of samples 12 to 14 of this invention.

Subsequently, by the same procedure as above, emulsified dispersions were prepared in accordance with the constituent elements shown in Table 1 for use in a green-sensitive layer and blue-sensitive layer. In this procedure, 1.0 g of the comparative polymer (1) or (2) was used as a comparative compound, and for the preparation of samples of this invention, the surface-active polymers (1), (3) and (6) were used.

TABLE 1

| | |
|---|---|
| Sixth layer (protective layer): Gelatin | 1600 mg/m$^2$ |
| Fifth layer (red-sensitive layer) | |
| Silver chlorobromide emulsion (50 mole % of silver bromide) Amount of silver coated | 300 mg/m$^2$ |
| Cyan coupler (*1) | 400 mg/m$^2$ |

TABLE 1-continued

| | |
|---|---|
| Coupler solvent (*2) | 300 mg/m$^2$ |
| Gelatin | 500 mg/m$^2$ |
| Fourth layer (ultra violet absorbing layer) | |
| Ultra violet absorbing agent (*3) | 600 mg/m$^2$ |
| Solvent (*2) for ultra violet absorbing agent | 300 mg/m$^2$ |
| Gelatin | 800 mg/m$^2$ |
| Third layer (green-sensitive layer) | |
| Silver chlorobromide emulsion (70 mole % silver bromide) Amount of silver coated | 500 mg/m$^2$ |
| Magenta coupler (*4) | 400 mg/m$^2$ |
| Antifading agent (*5) | 200 mg/m$^2$ |
| Coupler solvent (*6) | 400 mg/m$^2$ |
| Gelatin | 700 mg/m$^2$ |
| Second layer (interlayer) | |
| Gelatin | 1000 mg/m$^2$ |
| First layer (blue-sensitive layer) | |
| Silver chlorobromide (80 mole % silver bromide) Amount of silver coated | 400 mg/m$^2$ |
| Cyan coupler (*7) | 500 mg/m$^2$ |
| Coupler solvent (*2) | 400 mg/m$^2$ |
| Gelatin | 700 mg/m$^2$ |

Support: paper support having both surface laminated with polyethylene
In the table, "mg/m$^2$" represents the unit of the coated amount, and the asterisked compounds are as follows:
(*1): Coupler
2-[α-(2,4-Di-tert-pentylphenoxy)butanamido]-4,6-dichloro-5- methylphenol
(*2): Solvent
Trinonyl phosphate
(*3): Ultra violet absorbing agent
2-(2-Hydroxy-3-sec-butyl-5-tert-butylphenol)benzotriazole
(*4): Coupler
1-(2,4,6-Trichlorophenyl)-3-(2-chloro-5-tetra-decanamido)anilino-2-pyrazolon-5-one
(*5): Antifading agent
2,5-Di-tert-hexylhydroquinone
(*6): Solvent
Tricresyl phosphate
(*7): Coupler
α-Pivaloyl-α-(2,4-dioxy-5,5'-dimethyloxazolidin-3-yl)-2-chloro-5-[α-(2,4-di-tert-pentyloxy)butan-amido]acetanilide Each of the resulting multilayer samples 10 to 14 was exposed imagewise, and then continuously developed in an area of 100 m$^2$ in accordance with the following steps.

| | | |
|---|---|---|
| Color developing step | 3 min. 30 sec. | 3 min. 30 sec. |
| Rinsing in water (1) | — | 20 sec. |
| Bleaching-fixing step | 1 min. 30 sec. | 1 min. 30 sec. |
| Rinsing in water (2) | 3 min. | 3 min. |

(Each of the treating times includes the time in each bath and the crossover time to the next bath.)

The treating solutions used are shown in Table 2, and the treating conditions are shown in Table 3.

TABLE 2

| | Liquor in the tank | Liquor replenished |
|---|---|---|
| Color developing solution | | |
| Water | 800 ml | 800 ml |
| Trisodium nitrilotriacetate | 2.0 g | 2.0 g |
| Benzyl alcohol | 14 ml | 17 ml |
| Diethylene glycol | 10 ml | 10 ml |
| Sodium sulfite | 2.0 g | 2.5 g |
| Hydroxylamine sulfate | 3.0 g | 3.5 g |
| Potassium bromide | 0.5 g | — |
| Sodium carbonate | 30 g | 35 g |
| N—ethyl-N—(β-methanesulfonamido-ethyl),-3-methyl-4-aminoaniline sulate | 5.0 g | 7.0 g |
| Water to make | 1000 ml | 1000 ml |
| pH | 10.15 | 10.55 |
| Bleaching-fixing solution | | |
| Water | 400 ml | 400 ml |
| Ammonium thiosulfate (70% solution) | 150 ml | 300 ml |

TABLE 2-continued

| | Liquor in the tank | Liquor replenished |
|---|---|---|
| Sodium sulfite | 18 g | 36 g |
| Iron (III) ammonium ethylene-diaminetetraacetate | 55 g | 110 g |
| Disodium ethylenediaminetetra-acetate | 5 g | 10 g |
| Water to make | 1000 ml | 1000 ml |
| pH | 6.70 | 6.50 |

TABLE 3

| Processing step | Temperature (°C.) | Amount replenished (per m$^2$) | Tank capacity of an automatic processor |
|---|---|---|---|
| Color development | 33.0 | 330 ml | 96 liters |
| Rinsing (1) | 24–26 | 100 ml | 26 liters |
| Bleaching-fixing | 33.0 | 60 ml | 50 liters |
| Rinsing (2) | 24–26 | 10 liters | 26 liters × 3 |

The degree of contamination of the developing solution used in the above processing was evaluated. When the comparative film sample 10 prepared by using the comparative polymer (1) was processed by this developing solution, marked foaming on the surface of the developing solution was observed. Furthermore, a tarry "scum" adhered to the wall surface of the bath, showing marked contamination.

When the comparative film sample 11 prepared by using the comparative polymer (2) was processed by the developing solution, foaming on the surface of the developing solution was considerably reduced, and the contamination of the film was also decreased. It is seen however from Table 4 that the dispersed particles were large and the quality of the image was markedly reduced.

In contrast, with the samples (12) to (14) in accordance with this invention, scarcely any foaming was observed in the developing solution, and no "scum" formed. It was thus demonstrated that the contamination of the developing solution was greatly reduced, and the particles in the dispersion became smaller.

TABLE 4

| Film sample No. | Emulsifier used | Contamination of the developing solution | Average particle diameter of the dispersed particles in the red-sensitive layer (μm) |
|---|---|---|---|
| 10 (comparison) | Comparative polymer (1) | Heavy | 0.18 |
| 11 (comparison) | Comparative | A little | 0.35 |
| 12 (invention) | Surface-active polymer (1) | None | 0.15 |
| 13 (invention) | Surface-active polymer (3) | None | 0.13 |
| 14 (invention) | Surface-active polymer (6) | None | 0.16 |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one photographic silver halide emulsion layer, said light-sensitive material containing at least one hydrophilic organic colloid layer in which at least one photographically useful reagent is dispersed in the presence of a surface-active polymer, said polymer containing at least 5 mole% of units represented by the following general formula (I-1) or (I-2)

General formula (I-1)

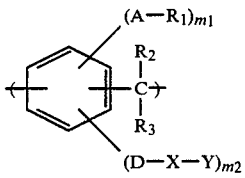

General formula (I-2)

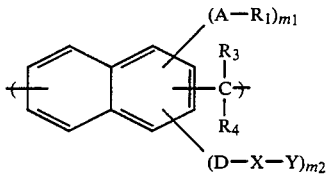

wherein $R_1$ represents a substituted or unsubstituted alkyl, alkenyl or aryl group having 1 to 30 carbon atoms, A and D each represents a single bond or a divalent linking group, $R_2$ represents a substituted or unsubstituted alkyl or aryl group, $R_3$ and $R_4$ each represents hydrogen or a substituted or unsubstituted alkyl or aryl group, $R_2$ and $R_3$ or $R_3$ and $R_4$ may respectively form a ring, X represents a single bond or a substituted or unsubstituted alkylene, alkenylene or arylene group, Y represents —COOM, —$SO_3M$, —O—$SO_3M$ or $$-O-\underset{\underset{O}{\|}}{P}-(OM)_2$$

in which M represents hydrogen or an inorganic or organic cation, $m_1$ is an integer of 1 to 3, and $m_2$ is 1 or 2.

2. The photographic light-sensitive material of claim 1, wherein the amount of the units formula (I-1) or (I-2) in the surface-active polymer is at least 10 mole%.

3. The photographic light-sensitive material of claim 1, wherein the surface-active polymer has a molecular weight of 600 to 10,000.

4. The photographic light-sensitive material of claim 3, wherein the surface-active polymer has a molecular weight of 900 to 5,000.

5. The photographic light-sensitive material of claim 1, wherein the at least one photographically useful reagent are dye image-forming couplers which couple with the oxidation products of aromatic primary amine developing agents to form colored or colorless dyes.

* * * * *